United States Patent [19]

North

[11] Patent Number: 4,458,478

[45] Date of Patent: Jul. 10, 1984

[54] ELASTIC ASSEMBLY, FOR EXAMPLE BRACELET OR RING

[76] Inventor: Jean M. North, Faubourg du Lac 31, Neuchatel, Switzerland

[21] Appl. No.: 333,861

[22] PCT Filed: Apr. 24, 1981

[86] PCT No.: PCT/CH81/00045

§ 371 Date: Dec. 14, 1981

§ 102(e) Date: Dec. 14, 1981

[87] PCT Pub. No.: WO81/02970

PCT Pub. Date: Oct. 29, 1981

[30] Foreign Application Priority Data

Apr. 25, 1980 [CH] Switzerland ..... 3191/80

[51] Int. Cl.[3] ..... F16G 13/00

[52] U.S. Cl. ..... 59/79.3; 224/175; 224/178; 403/292; D11/19; D11/25

[58] Field of Search ..... 59/79.3, 79.1, 80, 82; 63/5 R; 224/175, 178, 164; 403/291, 292, 297; 24/265 WS, 265 B; D11/19, 25

[56] References Cited

U.S. PATENT DOCUMENTS

| | | | |
|---|---|---|---|
| 815,899 | 3/1906 | Bliss | 59/79 B |
| 2,429,036 | 10/1947 | Taegtstroem | 59/79 |
| 2,699,035 | 1/1955 | Becker | 59/80 |
| 2,840,982 | 7/1958 | Stiegele | 59/79 |
| 3,208,211 | 9/1965 | Heinz | 59/79 B |

FOREIGN PATENT DOCUMENTS

| | | |
|---|---|---|
| 1330635 | 5/1963 | France . |
| 1497270 | 8/1967 | France . |
| 2197541 | 3/1974 | France . |
| 252410 | 10/1948 | Switzerland . |
| 594379 | 1/1978 | Switzerland . |

*Primary Examiner*—Francis S. Husar
*Assistant Examiner*—Linda McLaughlin
*Attorney, Agent, or Firm*—Bacon & Thomas

[57] ABSTRACT

Extensible metal assembly, for example bracelet or ring, comprising link members (1) and connecting members (2). Each link member has at its center a cavity (3) which goes right through in the longitudinal direction of the bracelet. The side walls of said cavity have each two holes (4). The connecting member is formed by a flattened tubular envelope. In this envelope there is provided a spring (6) having four S-shaped arms. The ends of those arms form studs (5) which project by pairs on either side of the tube. The tube has a width slightly smaller than that of the cavity (3). The connecting member is arranged on the side of the cavity (3), in the same plan as the rigid element, and pushed into the cavity. Upon passing, two of the studs (5) slide against the edges (8), are retracted into the opening (7) of the tube, and expand into the holes (4), fixing the members together.

7 Claims, 12 Drawing Figures

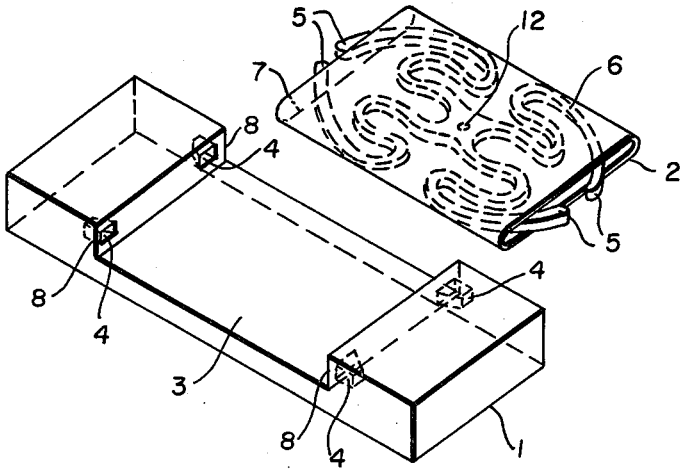
FIG. 1
FIG. 2
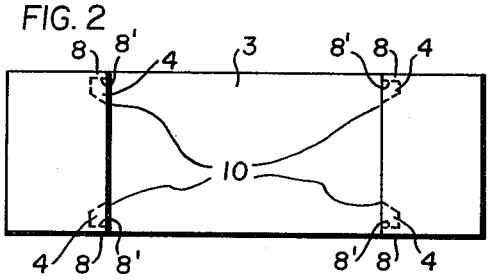
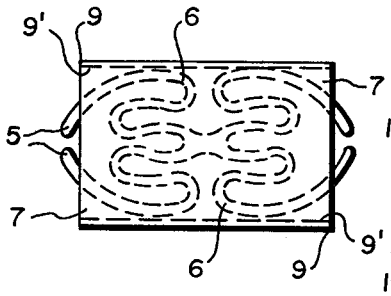
FIG. 3
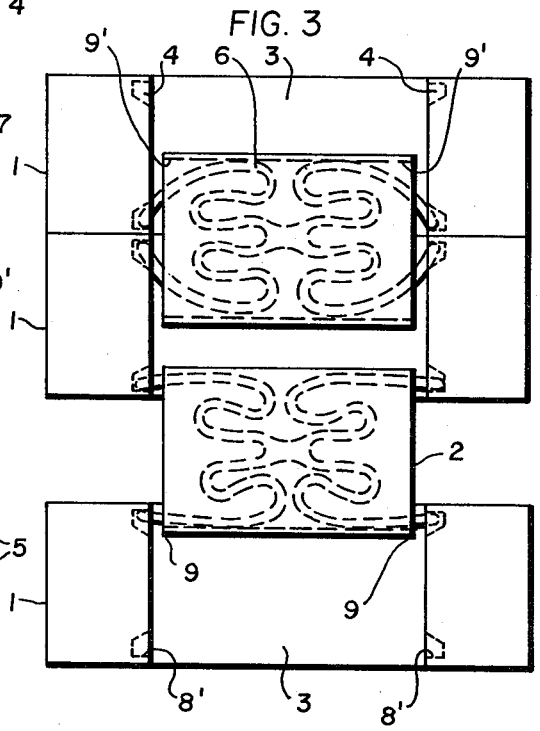
FIG. 4
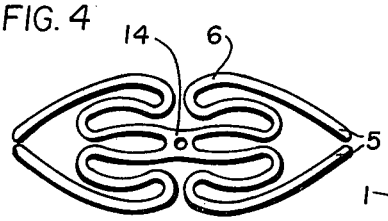

FIG. 5A
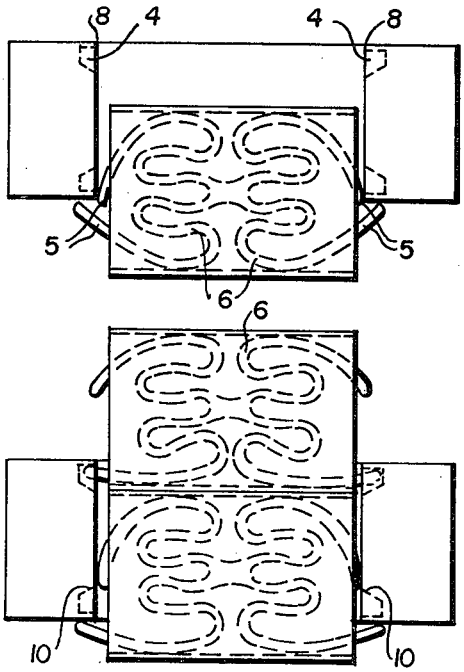
FIG. 5B
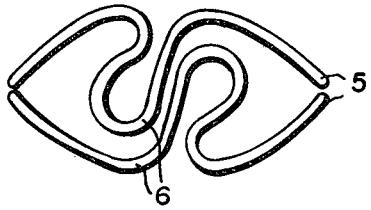
FIG. 10
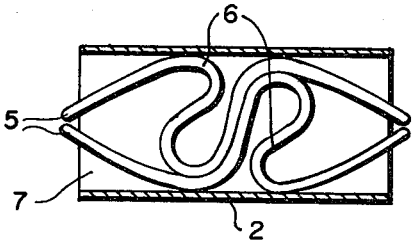
FIG. 11
FIG. 6
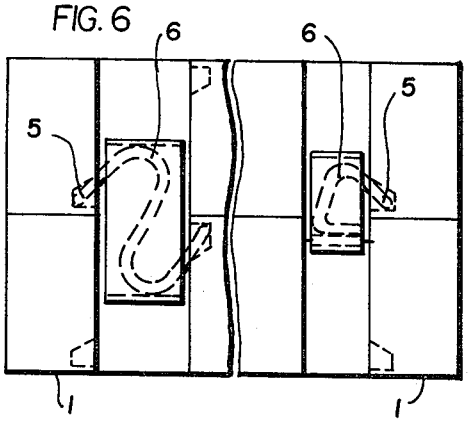
FIG. 8
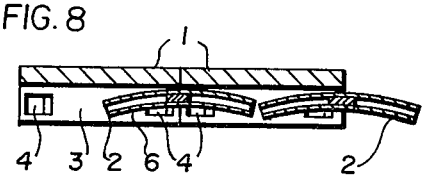
FIG. 9
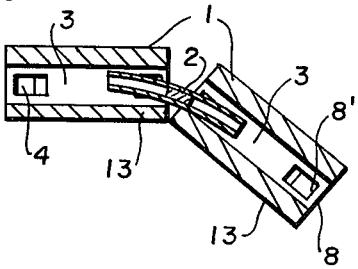
FIG. 7
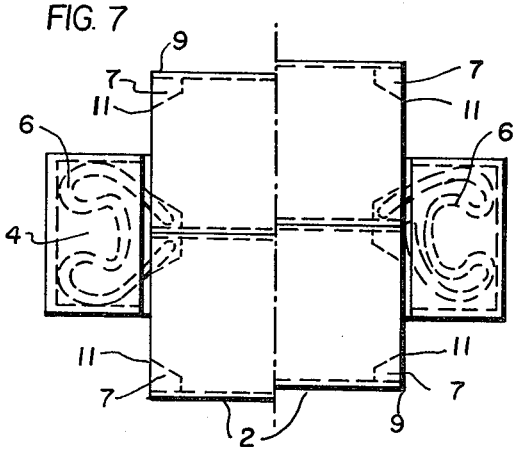

ELASTIC ASSEMBLY, FOR EXAMPLE BRACELET OR RING

BACKGROUND OF THE INVENTION

1. Field of the Invention

The invention concerns the field of extensible assemblies, specially that of elastic bracelets and rings, more particularly made of metal.

2. Description of the Prior Art

There are many existing extensible assemblies, notably metal ones, and more particularly bracelets, which are formed of link members connected together by spring elements. Most of these bracelets are made of thin metal sheets, which are bent so as to form hollow elements capable of accomodating the spring mechanism. At the present time, there is no existing assembly, specially and more particularly metal bracelets or rings, made of solid members 2 to 3 mm in thickness, and whose mechanism is integrated in an elegant way. Moreover, assembling and dismantling existing assemblies, as well as adapting their length, more especially adapting the length of a bracelet to the wearer's wrist, or the length of a ring to a finger, are complicated processes.

SUMMARY OF THE INVENTION

The object of this invention is to permit the construction of such an assembly, easy to assemble and dismantle, and presenting an aesthetic appearance. This invention can be applied, for example, to the construction of a bracelet or a ring.

BRIEF DESCRIPTION OF THE DRAWINGS

FIG. 1 is an oblique view of a link member 1 and of a connecting member 2, separated in the preferred form of embodiment.

FIG. 2 is a plan view of these same members, in the same form of embodiment, and likewise separated.

FIG. 3 is a plan view, in the same form of embodiment, of three link members joined together by two connecting members.

FIG. 4 is a plan view of a spring of a particularly favourable and aesthetic shape.

FIG. 5A and FIG. 5B are a plan view, in the same form of embodiment, of the phases of insertion and extraction of the connecting member into and from the link member.

FIG. 6 is a plan view of two particular forms of embodiment.

FIG. 7 is a plan view of a form of embodiment in which the studs which, as in the other drawings, are the two extremities of a spring, are fixed in the holes 4 in pairs.

FIG. 8 is a longitudinal section of a few members of a bracelet fitted with curved connecting members.

FIG. 9 is an identical section, in which the cavity 3 is covered by a plate 13.

FIG. 10 shows two springs, the studs being linked in pairs.

FIG. 11 shows the two springs of FIG. 10 inserted in the tube forming the connecting member.

DESCRIPTION OF THE PREFERRED EMBODIMENTS

The assembly comprises link members 1, which may be made in one piece or may result from the assembly of several components. Each link member presents at least one cavity 3 opening towards the adjacent link member, which itself presents at least one corresponding cavity. The preferred embodiment of the invention, and the simplest, is that shown in FIGS. 1 to 5, in which the cavity 3 traverses the link element from one edge to the other and presents straight walls. In each of these lateral walls, two holes 4 are made. The cavity 3 is so shaped that it can take, at least partially, at least one connecting member 2. In the preferred form of embodiment shown in FIGS. 1 to 5, the connecting member 2 presents the form of a flattened tube of approximately the same dimensions as the cavity 3, though slightly less broad, so that it can enter the latter. The connecting member is formed of a flattened tube with thin walls, preferably of metal. The connecting member presents two lateral apertures 7, which face the holes 4 when the connecting member is inserted into the cavity 3. Two pairs of studs 5 emerge from these apertures, fixed by means of elastic means 6 to the body of the connecting member (FIGS. 1 to 5).

In the forms of embodiment shown in the drawings, the elastic means are combined with the stud in a single elastic element or spring. This element is preferably made of metal, but it might also be made of an elastic synthetic material. In FIGS. 1 to 4, the connecting member comprises a spring, formed of four arms in the form of an S, the end of each of these arms constituting the studs 5 and, in pairs, projecting from the two apertures 7. The studs project obliquely from the aperture 7, so as to slide against the link member, when the connecting member is inserted into the cavity 3.

In the form of embodiment shown in FIGS. 1 to 5 and 8 to 9, the studs and the elastic means are made of a stamped or chemically eroded element, easy to manufacture. The S shape of the arms of the spring gives the latter the length necessary for ensuring sufficient flexibility.

The spring shown in FIGS. 1 and 4 presents a small hole or depression 12 at its centre. This depression is intended to make it possible to fix the spring into the connecting member by pushing the wall of the tube into the depression. That is not indispensable, however: it appears sufficient to give the spring a width slightly larger than that of the inside of the tube, so that the spring is fixed by the force of the friction which it exerts on the inside wall of the tube forming the connecting member 2.

In the embodiment of the connecting member shown in FIG. 11, the elastic means are made of two springs. The two springs are pushed against each other, even when the assembly is at rest, because of the dimensions of the tube. This is a means of pushing the link members together more strongly.

The assembling of the connecting members with the link members is done very simply, by placing the connecting member on the side of the cavity 3, in the same plane as the link member, and pushing it into this cavity. When it is thus inserted, the stud or studs come up against the edge 8 of the link member. Placed obliquely, the stud yields thanks to the bending of the elastic means 6 and retires into the aperture 7. When the end of the stud is facing the hole 4, it lodges itself in that hole under the effect of the slackening of the elastic means, that is to say, in the forms of embodiment shown here, of the spring. In the forms of embodiment shown in FIGS. 1 to 3 and 5 to 9, the connecting members are so dimensioned that they touch each other in the middle of the cavity 3. The fixing of a connecting member to the link member should be effected, if another connecting member is already fixed, by pushing the latter member (FIG. 5B). When the assembly, e.g. a bracelet, is extended (FIG. 3), the stud is blocked by the stops 8' and 9', which limit the hole 4 and the aperture 7, respectively.

The two link members at the top of the drawing of FIG. 3 are touching each other and are consequently in the position corresponding to that of the assembly when it is at rest, while the link member at the bottom is removed as far as possible from the preceding member, which corresponds to the maximum extension of the assembly: the springs 6 are extended, and the studs are butting against the stops 8' and 9'.

Apart from the simplicity of its assembly, the assembly which is the object of the invention offers the advantage of very easy dismantling. It is sufficient to push the connecting member in the same direction as for assembling (FIG. 5B). The stud then slides against a shoulder 10 facing the stop 8', on the other side of the hole 4. This movement is shown in FIG. 5A, the connecting member is being pushed in the direction of the arrow. Under the pressure of the edge 8, two studs 5 have partially retired into the body of the connecting member. In FIG. 5B, the connecting member has been pushed home: under the pressure of the shoulder 10, the studs retire again and come out of the holes 4, which makes it possible to extract the connecting member. In FIG. 5B, it can be seen how, when pushed home, the connecting member itself pushes the connecting member which is adjacent to it.

The cavity 3 is open in the forms of embodiment shown in FIGS. 1 to 3 and 5 to 8; it is possible, however, to cover it so that it opens only laterally, in the direction of the adjacent element (FIG. 9). Such covering has the advantage of giving the assembly, for example a bracelet, an identical, smooth appearance on its two faces. The construction, however, is then more complex, and the assembling and dismantling of the assembly less easy.

FIG. 1 shows a form of execution in which each wall presents two holes, while FIG. 6 shows a form of execution in which each wall has only one hole. On the left of FIG. 6, the connecting member presents only two studs, which are the two extremities of a spring in the form of an S. On the right, the connecting member is fixed to one of the link members by a pin bar, and to the other by a single stud.

In the preferred form of embodiment shown in FIGS. 1 to 3, 5, 6, 8 and 9, the tube forming the body of the connecting member presents two lateral apertures 7; in another form (FIG. 7), which is less favourable, the stud or studs 5 emerge from the hole 4, to the bottom of which they are fixed, also by means of the elastic means 6. In the form of execution shown in FIG. 7, the studs are also the two ends of a spring, whose central part is placed at the bottom of the hole 4, the two studs projecting into the cavity 3. Here, each of the springs 6 presents a loop in its centre. A small plate is inserted into the connecting member; in it is cut a shoulder 11 which makes it possible to extract the connecting member, in the same way as in the other forms of embodiment.

To ensure that the assembly is sufficiently supple, it is preferable to give the hole 4 and/or the aperture 7, in the thickness of the link and/or of the connecting member, a dimension slightly larger than that of the stud: this permits a certain play of the stud in relation to the link member and/or to the connecting member. Another way of ensuring this suppleness of the assembly, which can be combined with the preceding, consists in giving the connecting member a certain curvature. Connecting members presenting such a curvature are represented in FIGS. 8 and 9, which show the combination of curved connecting members and of holes 4 which are overdimensioned in the thickness of the link members.

The link member may be constructed in various ways. For example, it may be cut, by milling and piercing, or it may be partially drawn. Another possibility consists in cutting out several plates in an appropriate manner and then soldering them together. Lastly, there are various possible ways of making this element by bending. If it is made of a solid element, it may be advantageous to make the holes with a suitably shaped punch, mounted on a pneumatic hammer. The spring can be made according to the form drawn in FIG. 4; it is chemically eroded out of the metal, preferably bronze-beryllium. The connecting member 2 is cut out of a stainless steel tube made by stretching. The link member is cut in a stretched stainless steel section. This steel section is a strip on one face of which the cavity 3 is dug out.

The assembly, object of the invention, can be used particularly for bracelets, curb-chains, rings.

I claim:

1. An extensible assembly comprising:

a plurality of adjacent link members, each of said members having a cavity with two lateral walls facing each other and at least one hole in each of said walls; and a plurality of connecting members for connecting each two adjacent link members to each other, each of said connecting members comprising:

a body which is inserted into the respective cavities of two adjacent link members, where it can move along a direction substantially parallel to said walls;

two pairs of studs which are attached to said body and can be either in an expanded position into said holes where they are inserted respectively into the holes of said adjacent link members or in a retracted position where they are in contact with said lateral walls to allow the insertion of the connecting member in the cavities of the link members;

means for elastically urging said studs toward their expanded position; and stops means for preventing the studs, once they are inserted in said holes, from being extracted from the holes when the connecting member is pulled out of the cavities.

2. The extensible assembly of claim 1, wherein each hole has a shoulder on which the stud is able to slide to come out of said hole when the connecting member is pushed inside the cavity.

3. The extensible assembly of claims 1 or 2, wherein the body of the connecting element is in a tubular form having a flattened section, said urging means being located inside said body.

4. The extensible assembly of claim 3, wherein the body has inner walls and two ends, wherein one of each of said two pairs of studs is located at each of said two ends, wherein said inner walls contact said urging means so that each pair of studs is urged together in contact.

5. The extensible assembly of claim 3, wherein said urging means is formed by an elastic element having four arms which are attached together at one end, the other end of each arm forming one stud.

6. The extensible assembly of claim 5, wherein each arm has approximately the form of an S.

7. The extensible assembly of claim 1 wherein the studs are linked in pairs.

* * * * *